United States Patent [19]

Garcia et al.

[11] Patent Number: 5,055,217

[45] Date of Patent: Oct. 8, 1991

[54] POLYMER PROTECTED BLEACH PRECURSORS

[75] Inventors: Rigoberto F. Garcia, Nutley; Elizabeth M. Coppinger, Rutherford; Charles F. Irwin, Randolph; Angela M. Sangirardi, Saddle Brook, all of N.J.

[73] Assignee: Lever Brothers Company, Division of Conopco, Inc., New York, N.Y.

[21] Appl. No.: 543,640

[22] Filed: Nov. 20, 1990

[51] Int. Cl.[5] ..... C11D 3/395; C11D 3/60

[52] U.S. Cl. ..... 252/94; 252/174.13; 252/174.23; 252/547; 252/DIG. 2

[58] Field of Search ..... 252/174.13, 99, 547; 428/96

[56] References Cited

U.S. PATENT DOCUMENTS

| | | | |
|---|---|---|---|
| 3,256,198 | 6/1966 | Matzner . | |
| 3,272,750 | 9/1966 | Chase . | |
| 3,686,127 | 8/1972 | Boldingh . | |
| 3,833,506 | 9/1974 | Fries et al. . | |
| 3,925,234 | 12/1975 | Hachmann et al. . | |
| 4,009,113 | 2/1977 | Green et al. . | |
| 4,087,369 | 5/1978 | Wevers . | |
| 4,111,826 | 9/1978 | Leigh et al. . | |
| 4,276,312 | 6/1981 | Merritt | 426/96 |
| 4,283,301 | 8/1981 | Diehl . | |
| 4,372,868 | 2/1983 | Saran et al. . | |
| 4,397,757 | 8/1983 | Bright et al. . | |
| 4,399,049 | 8/1983 | Gray et al. . | |
| 4,412,934 | 11/1983 | Chung et al. . | |
| 4,444,674 | 4/1984 | Gray . | |
| 4,486,327 | 12/1984 | Murphy et al. . | |
| 4,536,314 | 8/1985 | Hardy et al. . | |
| 4,663,068 | 5/1987 | Hagemann | 252/99 |
| 4,678,594 | 7/1987 | Parfomak et al. . | |
| 4,751,015 | 6/1988 | Humphreys et al. . | |
| 4,919,841 | 4/1990 | Kamel | 252/174.13 |

FOREIGN PATENT DOCUMENTS

| | | |
|---|---|---|
| 0106584 | 4/1984 | European Pat. Off. . |
| 0136331 | 8/1984 | European Pat. Off. . |
| 0153322 | 12/1984 | European Pat. Off. . |
| 0153223 | 8/1985 | European Pat. Off. . |
| 0185522 | 6/1986 | European Pat. Off. . |
| 0202698 | 11/1986 | European Pat. Off. . |
| 836988 | 6/1960 | United Kingdom . |
| 864798 | 4/1961 | United Kingdom . |

*Primary Examiner*—Paul Lieberman
*Assistant Examiner*—Kevin D. McCarthy
*Attorney, Agent, or Firm*—Milton L. Honig

[57] ABSTRACT

A particulate detergent composition additive is disclosed wherein each particle is an intimately blended mixture of a bleach precursor, a binder and a sugar. The binder is a non-crosslinked polymer having in an unplasticized form a $T_g$ of at least 40° C. Suitable sugars include sorbitol, glucose, sucrose and lactose.

13 Claims, No Drawings

POLYMER PROTECTED BLEACH PRECURSORS

BACKGROUND OF THE INVENTION

1. Field of the Invention

The present invention relates to bleach promoting particles suitable for incorporation into detergent formulations.

2. The Related Art

Hydroperoxide generating compounds have long been known for their capability of removing stains from fabrics. Among the most commonly employed materials for this purpose is sodium perborate, either in the tetrahydrate or monohydrate form.

When laundering fabrics at or near the boil temperatures of 85° C. to 100° C., perborate and similar persalt materials perform well. Over the years, the temperatures at which consumers launder have, however, declined. Today it is common to conduct the washing process below 60° C. Under such conditions, the speed of active oxygen release from perborate and like materials is poor. To overcome the low temperature problem, bleach precursors, alternately known as promoters or activators, have been used in conjunction with the persalts.

The literature has documented a great number of materials that function effectively as bleach precursors. One of the earliest disclosures is found in U.S. Pat. No. 3,256,198 (Matzner) revealing $C_6$-$C_{10}$ alkyl sulphophenyl carbonates. Shorter chain carbonates have been reported in U.S. Pat. No. 3,272,750 (Chase). Other early patents in this area include GB 836,988 (Davies et al) and GB 864,798 (Hampson et al) reporting the use of aliphatic carboxylic acid esters as adjuncts for accelerating the bleach activity of persalts such as sodium perborate or percarbonate. Illustrative of esters mentioned therein are sodium acetoxybenzene sulphonate (SABS) and sodium benzoyloxybenzene sulphonate (SBOBS).

More recently in U.S. Pat. No. 4,412,934 (Chung et al), there was reported bleach precursors of the general formula RCOL where R is an alkyl group containing from 5 to 18 carbon atoms and L is a leaving group. Sodium nonanoyloxybenzene sulphonate (SNOBS) was identified therein as a particularly effective compound.

Further reports of ester precursors may be found in the following literature: U.S. Pat. No. 4,283,301 (Diehl); U.S. Pat. No. 4,536,314 (Hardy et al)); U.S. Pat. No. 3,686,127 (Boldingh et al); EP 0 106 584 (Hartman); EP 0 136 331 (Burns et al); EP 0 185 522 (Fong et al); EP 0 153 322 (Moyne et al); EP 0 153 223 (Moyne et al); and EP 0 202 698 (Nollet et al).

There also have been reported through U.S. Pat. No. 4,751,015 (Humphreys et al) a class of precursor compounds identified as quaternary ammonium or phosphonium substituted carbonic acid esters. Related quaternary ammonium carboxylic esters have been reported in U.S. Pat. No. 4,397,757 (Bright et al).

To a greater or lesser extent, all of the known bleach precursor compounds have problems with hydrolytic stability. Considerable work has been reported on efforts to combat the problem. U.S. Pat. No. 4,087,369 (Wevers) reports improving the storage stability of certain types of perbleach activator (precursor) through agglomeration with an agent that is chemically inert relative to the activator. Agglomerating agents suitable for use therein are generically described as having melting points in the range from about 25° C. to 100° C.

Specific classes include ethoxylated $C_{10}$-$C_{18}$ carboxylic acids, $C_{10}$-$C_{15}$ amides, polyethylene glycols, ethoxylated $C_8$-$C_{18}$ alkyl phenols, $C_{12}$-$C_{30}$ fatty acids and $C_{16}$-$C_{30}$ fatty alcohols.

U.S. Pat. No. 4,009,113 (Green et al) discloses a slightly different manner of protecting precursor compounds of the type listed by Wevers. Finely divided particulate precursor compound is evenly mixed with an inert carrier material. Around the resultant particle is placed an outer protective, non-deliquescent coherent layer of polyvinyl alcohol, polyacrylamide, copolymers of acrylic acid, methacrylic acid or maleic anhydride, starch and its modifications and derivatives (e.g. dextrins), water-soluble cellulose ether or water-soluble gum. Dextrin and sucrose are noted as preferred. A plasticizer may be incorporated within the outer protective layer. Typical plasticizers mentioned are urea, glycerol, ethylene glycol and esters of dibasic acids.

U.S. Pat. No. 3,925,234 (Hachmann et al) focuses upon stabilizing bleaching assistants of the N-acyl and O-acyl compound variety. Chief among these compounds is tetraacetyl glycoluril. Stabilization is accomplished by surrounding the bleaching assistant with another coating that is a mixture of $C_{12}$-$C_{24}$ fatty acid with fatty alcohols (or water-soluble ethoxylated derivatives thereof) in a weight proportion of 10:1 to 2:1.

U.S. Pat. No. 3,833,506 (Fries et al) is concerned with the same bleaching assistants as those of Hachmann et al. Stabilization is here accomplished by forming an intimate mixture between 10-70% of a bleaching assistant and 30-90% mixture of fatty acids and polyethylene glycol.

U.S. Pat. No. 4,678,594 (Parfomak et al) encapsulates a mixture of sodium nonanoyloxybenzene sulfonate (SNOBS) and sodium perborate in a matrix of nonionic ethoxylated alcohol surfactant. Use of ethoxylated nonionic surfactant as a storage stability and water-dispersibility aid for peroxy acid bleach presursors is also reported in U.S. Pat. No. 4,399,049 (Gray et al).

Other patents directed toward solving storage stability and/or dispersibility problems for bleach presursors include U.S. Pat. No. 4,444,674 (Gray), U.S. Pat. No. 4,111,826 (Leigh et al), and U.S. Pat. No. 4,372,868 (Saran et al).

U.S. Pat. No. 4,486,327 (Murphy et al) focuses upon branched alpha-substituted derivatives of $C_6$-$C_{18}$ carboxylic acid esters. Better storage stability of the activator is achieved by evenly distributing therewith a binder material which may be selected from nonionic surfactants, polyethylene glycols, anionic surfactants, film-forming polymers, fatty acids and mixtures thereof. Among the film-forming homo- and copolymers reported are those that include monomers selected from acrylic acid, methacrylic acid and maleic anhydride, with preference given to sodium polyacrylate.

While a great number of binder systems have been proposed, the systems often do not provide sufficiently swift solubility in water so as to timely deliver the peracid.

Another problem has been in the area of attrition resistance. Particles of binder and precursor must be sufficiently robust to withstand physical disintegration into smaller particle sizes when being blended with other particles such as detergent base powders.

Dustiness is a problem arising in large measure from low attrition resistance. Not only does dust present an explosion hazard, but long-term inhalation exposure by plant workers can lead to adverse health effects.

Accordingly, it is an object of the present invention to provide bleach precursor particles that exhibit improved water solubility and excellent water dispersibility in a wash medium.

Another object of the present invention is to provide bleach presursor particles of improved attrition resistance.

A further object of the present invention is to provide bleach precursor particles of low dustiness.

A still further objective of the present invention is to provide a detergent composition containing the bleach precursor particle which will deliver a high level of cleaning performance against stains.

These and other objects of the invention will become more apparent through the following detailed description.

SUMMARY OF THE INVENTION

A particulate detergent composition additive is provided wherein each particle is an intimately blended mixture comprising:

(i) from about 1 to 98% of a bleach precursor compound capable of generating a peroxyacid in the presence of a hydroperoxide source;

(ii) from about 1 to 50% of a binder which is a non-crosslinked polymer having in an unplasticized form a $T_g$ of at least 40° C.; and (iii) from about 0.5 to 20% of a plasticizer which is a sugar.

Additionally, there are provided detergent compositions that include the particulate additive which compositions comprise:

(i) from about 1 to 60% of a peroxygen compound capable of yielding hydroperoxide in an aqueous solution, (ii) from about 0.1 to 40% of the aforedescribed particulate additive with incorporated bleach precursor;

(iii) from about 0 to 50% of a surfactant; and (iv) from about 0 to 70% of a detergent builder.

DETAILED DESCRIPTION OF THE INVENTION

High temperature melting polymers have been found to be useful as binders for peroxy bleach precursors. These polymers offer an advantage over the standard polyethylene glycol and ethoxylated alcohol-type binders in the property of improved attrition resistance and dustiness. Very high levels (over 80% by weight) of precursors can be incorporated into particles formed with polymeric binder.

The binder of the present invention will be a polymer which, in its virgin, nonplasticized form, will have a glass transition temperature ($T_g$) of at least 40° C., preferably at least 70° C., and optimally at least 150° C. The upper limit is of no particular significance, although in most polymers that are herein suitable, the upper limit would not be higher than about 400° C.

Suitable binders will be those non-crosslinked, non-swellable homo- and copolymers formed from monomers such as acrylic acid, its salt and $C_1$–$C_{20}$ alkyl ester derivatives; methacrylic acid, its salt and $C_1$–$C_{20}$ alkyl ester derivatives; maleic anhydride, its salt, its acid and $C_1$–$C_{20}$ alkyl ester derivatives; styrene; ethylene; vinyl pyrollidone; vinyl acetate and mixtures thereof. Examples of these materials include polyvinyl pyrollidone (available as PVP K-15), sodium polyacrylate crysol LMW10D and LMW45D), styrene-acrylic copolymer (Joncryl 682), copolymers of vinyl acetate and crotonic acid (Resyn 28-1310 and Resyn 28-2930), and polyvinyl acetate (Vinol 205). Most preferred are the acrylate-maleate copolymers and their ester, acid and salt derivatives, best exemplified by Narlex MA 340 and 345, products of the National Starch and Chemical Company.

The amount of binder may range from about 1 up to about 98% by weight of the particulate additive, preferably from about 2 to 20%, optimally between about 5 and 12%.

Another important component of the particles according to the present invention is a plasticizer which is a sugar. Suitable sugars include sorbitol, glucose, sucrose, lactose and mixtures thereof. Most preferred is sorbitol.

Generally, the sugar will be present in an amount from about 0.5 to 20% by weight of the particle, preferably from about 2 to 12%, optimally between about 5 and 10%.

All types of precursors may be formulated with the binder/sugar systems of the present invention. Examples include:

(a) N-diacylated and N,N'-polyacylated amines, such as N,N,N',N'-tetraacetyl methylene diamine and N,N,N',N'-tetraacetyl ethylene diamine, N,N-diacetylaniline, N,N-diacetyl-p-toluidine; 1,3-diacylated hydantoins such as, for example, 1,3-diacetyl-5,5-dimethyl hydantoin and 1,3-dipropionyl hydantoin; acetoxy-(N,N,N')-polyacylmalonamide, for example acetoxy-(N,N')-diacetylmalonamide;

(b) N-alkyl-N-sulphonyl carbonamides, for example the compounds N-methyl-N-mesyl-acetamide, N-methyl-N-mesylbenzamide, N-methyl-N-mesyl-p-nitrobenzamide, and N-methyl-N-mesyl-p-methoxybenzamide;

(c) N-acylated cyclic hydrazides, acylated triazones or urazoles, for example monoacetylmaleic acid hydrazide;

(d) O,N,N-trisubstituted hydroxylamines, such as O-benzoyl-N,N-succinyl hydroxylamine, O-acetyl-N,N-succinyl hydroxylamine, O-p-methoxybenzoyl-N,N-succinylhydroxylamine, O-p-nitrobenzoyl-N,N-succinylhydroxylamine and O,N,N-triacetyl hydroxylamine;

(e) N,N'-diacyl-sulphurylamides, for example N,N'-dimethyl-N,N'-diacetyl-sulphurylamide and N,N'-diethyl-N,N'-dipropionyl sulphurylamide;

(f) Triacylcyanurates, for example triacetyl cyanurate and tribenzoyl cyanurate;

(g) Carboxylic acid anhydrides, such as benzoic anhydride, m-chloro-benzoic anhydride, phthalic anhydride, 4-chloro phthalic anhydride;

(h) Esters, for example glycose pentaacetate, xylose tetraacetate, sodium acetyloxybenzene sulfonate, sodium nanoyloxybenzene sulfonate and sodium benzoyloxybenzenesulfonate;

(i) 1,3-Diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy-imidazoline;

(j) Tetraacetylglycoluril and tetrapropionylglycoluril;

(k) Diacylated 2,5-diketopiperazine, such as 1,4-diacetyl-2,5-diketopiperazine, 1,4-dipropionyl-2,5-diketopiperazine and 1,4-dipropionyl-3,6-dimethyl-2,5-diketopiperazine;

(l) Acylation products off propylenediurea or 2,2-dimethylpropylenediurea (2,4,6,8-tetraaza-bicyclo- (3,3,1)-nonane-3,7-dione or its 9,9-dimethyl derivative), especially the tetraacetyl- or the tetrapropionyl-propylenediurea or their dimethyl derivatives;

(m) Carbonic acid esters, for example the sodium salts of p-(ethoxycarbonyloxy)-benzoic acid and p-(propoxycarbonyloxy)-benzenesulphonic acid;

(n) Acyloxy-(N,N')polyacyl malonamides, such as alpha-acetoxy(N,N')diacetyl malonamide; and (o) Quaternary ammonium substituted peroxycarbonic or carboxylic acid esters such as 2-(N,N,N-trimethylammonium) ethyl sodium 4-sulphophenyl carbonate.

The precursors mentioned under (a), (h), (j) and (o) are of special interest, particularly N,N,N',N'-tetraacetyl-ethylene-diamine (TAED), tetraacetyl-glycoluril (TAGU), glucose pentaacetate, xylose tetraacetate, sodium acetyloxybenzene sulfonate (SABS) and sodium nonanoyloxybenzene sulfonate (SNOBS).

Most preferred, however, is sodium benzoyloxybenzene sulfonate.

Amounts of the precursor within the particulate additive will range from about 1% to 98% by weight, preferably between about 50 and 95%, optimally between about 75 and 92%.

The ratio of precursor to binder may range from about 100:1 to 1:20, preferably from about 20:1 to 8:1; optimally between 9:1 and 3:1.

The foregoing particulate additives containing precursors may be incorporated into detergent bleach compositions which require as an essential component a peroxygen bleaching compound capable of yielding hydroperoxide in an aqueous solution.

Hydroperoxide sources are well-known in the art. They include the alkali metal peroxides; organic peroxide compounds such as urea peroxide; and inorganic persalt compounds such as the alkali metal perborates, percarbonates, perphosphates, persilicates and persulfates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. Rapid dissolution is believed to permit formation of higher levels of percarboxylic acid which would enhance surface bleaching performance.

A detergent formulation containing a bleach system consisting of an active oxygen releasing material and the particulate precursor additive of the invention will usually also contain surface-active materials, detergency builders and other known ingredients of such formulations.

The surface-active material may be naturally derived, such as soap or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4 to 25%.

Synthetic anionic surface-actives are usually water-soluble alkali metal salts of organic sulphates and sulfonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced for example from tallow or coconut oil; sodium and ammonium alkyl ($C_9$–$C_{20}$) benzene sulfonates, particularly sodium linear secondary alkyl ($C_{10}$–$C_{15}$) benzene sulfonates; sodium alkyl glyceryl ether sulfates, especially those ethers of the higher alcohols derived from tallow coconut oil and synthetic alcohols derived from petroleum; sodium coconut oil fatty acid monoglyceride sulphates and sulfonates; sodium and ammonium salts of sulphuric acid esters of higher ($C_9$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulfonate; sodium and ammonium $C_7$–$C_{12}$ dialkyl sulfosuccinates; and olefinic sulfonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulfonates; sodium ($C_{16}$–$C_{18}$) alkyl sulfates and sodium ($C_{16}$–$C_{18}$)alkyl ether sulfates.

Examples of suitable nonionic surface-active compounds which may be used preferably together with the anionic surface active compounds, include in particular, the reaction products of alkylene oxides, usually ethylene oxide, with alkyl ($C_6$–$C_{22}$) phenols, generally 2–25 EO, i.e. 2–25 units of ethylene oxides per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The detergent compositions of the invention will normally also contain a detergency builder. Builder materials may be selected from (1) calcium sequestrant materials, (2) precipitating materials, (3) calcium ion-exchange materials and (4) mixtures thereof.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate, tartrate mono- and di-succinates, oxydisuccinate, crystalline or amorphous aluminosilicates and mixtures thereof.

Polycarboxylic homo- and co-polymers may also be included as builders and to function as powder structurants or processing aids. Particularly preferred are polyacrylic acid (available under the trademark Acrysol from the Rohm and Haas Company) and acrylic-maleic acid copolymers (available under the trademark Sokalan from the BASF Corporation) and alkali metal or other salts thereof.

These builder materials may be present at a level of, for example, from 1 to 80% by weight, preferably from 10 to 60% by weight.

Upon dispersal in a wash water, the initial amount of peroxygen compound should range in amount to yield anywhere from about 0.05 to about 250 ppm active oxygen per liter of water, preferably between about 1 to 50 ppm. Surfactant should be present in the wash water from about 0.05 to 1.0 grams per liter, preferably from 0.15 to 0.20 grams per liter. When present, the builder amount will range from about 0.1 to 3.0 grams per liter.

Apart from the components already mentioned, the detergent compositions of the invention can contain any of the conventional additives in the amounts in which such materials are normally employed in detergent compositions. Examples of these additives include lather boosters such as alkanolamides, particularly the monoethanolamides derived from palmkernel fatty acids and coconut fatty acids, lather depressants such as alkyl phosphates and silicones, antiredeposition agents such as sodium carboxymethylcellulose and alkyl or substituted alkylcellulose ethers, other stabilizers such as ethylene diamine tetraacetic acid, fabric softening agents, inorganic salts such as sodium sulphate and usually present in very small amounts, fluorescent whitening agents, perfumes, enzymes such as proteases, cellulases, lipases and amylases, germicides and colorants.

The bleach precursors and their peroxy acid derivatives described herein are useful in a variety of cleaning products. These include laundry detergents, laundry bleaches, hard surface cleaners, toilet bowl cleaners, automatic dishwashing compositions and even denture cleaners. Precursors of the present invention can be introduced in a variety of product forms including powders, on sheets or other substrates, in pouches, in tablets or in nonaqueous liquids such as liquid nonionic detergents.

The following examples will more fully illustrate the embodiments of this invention. All parts, percentages and proportions referred to herein and in the appended claims are by weight unless otherwise illustrated.

EXAMPLE 1

Processing

Granulation Technique

In this procedure the precursor powder (e.g. SBOBS) was loaded into an RV02 pan granulator and blended for a minute with the pan and rotor at high speed (i.e. 64 rpm and 3600 rpm, respectively). Binder solution consisting of the desired Narlex MA345 and sugar (e.g. sorbitol) in water was slowly injected onto the rotating powder. When the desired particle size was not achieved after all the binder had been injected, small increments of water were added till agglomerates of the desired particle size were obtained. Granules were then died at 70° C. in an Aeromatic fluid bed dryer for approximately 40 minutes to a moisture of 0.5–1.0%.

Extrusion Technique

In this procedure the powdered precursor (e.g. SBOBS), was added to the anhydrous binder slowly with rapid agitation in a Hobart Mixer, so as to increase wetting of the presursor. The powdered mixture was then loaded into a heated single axial screw extruder having a 1 mm die plate and a rotating cutter blade. Extrusion temperatures ranged from 100° to 150° C. These extrusion temperatures allowed the powdered mass to soften and become almost plastic in nature. Noodles exiting from the die plate were cut to the desired particle size by a rotating blade.

EXAMPLE 2

Details of Test Methods

Dissolution Test

Release rates for precursors containing particulates were determined by the use of UV-Visible spectrophotometry. A sample of the particles was added to a beaker with water of 12° FH hardness and a pH of 7.0 held at a temperature of 10° C. with mixing at 240 rpm. Concentration of the granule in water was somewhere between 1 and $1.2\times10^{-4}$ molar. Timed 1 ml. samples of the dispersion were then pulled at various times by syringe through a 0.45 micron HV Millex filter and mixed with 3 mls. of water. Times of sampling were every 0.25 minutes for the first minute, every 0.5 minutes for the next 3 minutes then every 2 minutes till 14 minutes (except at 8 minutes). A Perkin Elmer UV-Visible Spectrophotometer set at a wave length between 219 and 236 nm was used to measure the absorbance of the filter samples. A computer program was used to plot absorbance against time and to fit the curve to a first order rate reaction function. Thereby, the K value was determined which was then used to derive $T_{90}$.

Attrition Test

The procedure involved fluidizing 125 g of a powder at two times its minimum fluidization velocity for 1 hour in a glass tube 175 cm long and 3.45 cm ID.

Particles elutriated from the top of the glass tube were diluted with a cross flow air stream. Particles which were less than 5 microns in size were counted and sized by a HIAC/ROYCO particle analyzer (set at 0.1 cfm) which used light scattering detection principles. This technique provided a particle size distribution for particles less than 5 microns at any given time (particles were counted for 20 seconds) as well as total counts of these particles as a function of time. The particle analyzer included a Model 4300 multichannel particle counter and a Model 1200 air sensor. Weight percent elutriated per hour (amount of sample elutriated/weight of sample used) was reported as the index of attrition (% loss).

The dilution air stream was produced by a combination of a compressed air source at the inlet and a vacuum source at the exhaust. The flow rate of this stream was set at 470 l/min. and was set by obtaining the corresponding pressure drop through the orifice. The ratio of the amount of compressed air to that of the vacuum source was such that the pressure at measuring point (A) was essentially atmospheric. This resulted in a flow rate of 8.25 cubic feet/hour (0.1375 cfm) into the sensor when it was both connected and disconnected from point (A).

EXAMPLE 3

A representative particulate additive formulation was prepared to evaluate a variety of plasticizers in combination with the binder polymer. The basic formula is as follows:

TABLE I

| Component | Weight % |
|---|---|
| Sodium benzoyloxybenzene sulfonate | 85.25 |
| Narlex MA340 or MA345 | 7.25 |
| Plasticizer | 7.50 |

Various plasticizers were evaluated in the above basic formula to ascertain rate of dissolution ($T_{90}$) and attrition characteristics (% loss). Dust control was also evaluated to determine health and explosion hazards associated with the particulate additive. Maximum acceptable levels for $T_{90}$ is 2.0 minutes, preferably no higher than 1.0 minutes. Attrition % loss is satisfactory when less than 1%, preferably no higher than 0.6%. Dust Count must be no higher than 100,000, preferably no higher than 50,000.

TABLE II

| Binder | Plasticizer | T90 | Attrition % Loss | Dust Count |
|---|---|---|---|---|
| MA345 | Sorbitol | 1.15* | 0.41* | 25,000* |
| MA340 | Sorbitol | 1.1 | 0.16 | 45,000 |
| MA345 | Glycerin | 1.0 | 0.88 | 5,000 |
| MA345 | Propylene glycol | 0.6 | 1.21 | 300,000 |
| MA345 | Glucose | 1.0 | 0.26 | 50,000 |
| MA345 | Mannitol | 0.8 | 0.82 | 150,000 |
| MA345 | Sucrose | 1.3 | 0.45 | 45,000 |
| MA345 | Lactose | 0.8 | 0.37 | 80,000 |
| MA345 | Ethylene glycol | 0.6 | 1.03 | 15,000 |
| MA345 | None | 0.7 | 1.60 | 200,000 |
| MA345 | PEG 1450 | 0.7 | 0.65 | 90,000 |

*Average

From the above table it is evident that compounds such as propylene glycol and mannitol have unacceptable dust counts. Even PEG 1450 has a dust count on the high side. Unacceptable attrition loss was observed with particulates containing ethylene glycol and propylene glycol. Absent any plasticizer, both attrition loss and dust count were both unsatisfactory.

The foregoing description and examples illustrate selected embodiments of the present invention. In light thereof, various modifications will be suggested to one skilled in the art, all of which are within the spirit and purview of this invention.

What is claimed is:

1. A particulate detergent composition additive is provided wherein each particle is an intimately blended mixture comprising:

(i) from about 1 to 98% of a bleach precursor compound capable of generating a peroxyacid in the presence of a hydroperoxide source;

(ii) from about 1 to 50% of a binder which is a non-crosslinked polymer having in an unplasticized form a $T_g$ of at least 40° C., said polymer being a polycarboxylic homo or copolymer formed from monomers selected from the group consisting of acrylic acid, its salt and $C_1$-$C_{20}$ alkyl ester derivatives; methacrylic acid, its salt and $C_1$-$C_{20}$ alkyl ester derivatives; maleic anhydride, its salt, its acid and $C_1$-$C_{20}$ alkyl ester derivatives; styrene; ethylene; vinyl pyrollidone; vinyl acetate and mixtures thereof; and (iii) from about 0.5 to 20% of a plasticizer which is a sugar.

2. A particulate additive according to claim 1, wherein the $T_g$ is at least 70° C.

3. A particulate additive according to claim 1, wherein said precursor and binder are present in a weight ratio that ranges from about 9:1 to 3:1.

4. A particulate additive according to claim 1, wherein said binder is selected from the group consisting of polyvinyl pyrollidone, sodium polyacrylate, acrylate-maleate copolymer, styrene/acrylic copolymer, vinyl acetate/crotonic acid copolymers and polyvinyl acetate.

5. A particulate additive according to claim 1, wherein said binder is an acrylate-maleate copolymer.

6. A particulate additive composition according to claim 1, wherein said binder is present in an amount of from about 2% to about 20% by weight.

7. A particulate additive according to claim 1, wherein said precursor is present in an amount from about 50% to about 95% by weight.

8. A particulate additive according to claim 1, wherein said sugar is present in an amount of from about 2 to 12% by weight.

9. A particulate additive according to claim 1, wherein said precursor is selected from the group consisting of carboxylic acid esters, carbonic acid esters, quaternary ammonium and phosphonium substituted carbonic or carboxylic acid esters, and N-acyl esters.

10. A particulate additive according to claim 1, wherein said precursor is a compound selected form the group consisting of sodium nonanoyloxybenzene sulfonate and sodium benzoyloxybenzene sulfonate.

11. A particulate additive according to claim 1, wherein said sugar is sorbitol.

12. A particulate additive according to claim 1, wherein said sugar is selected from the group consisting of glucose, sucrose, lactose and mixtures thereof.

13. A detergent composition comprising:

(i) from about 1 to 60% of a peroxygen compound capable of yielding hydroperoxide in an aqueous solution;

(ii) from about 0.1 to 40% of said particulate additive of claim 1;

(iii) from about 0 to 70% of a detergent builder.

* * * * *